US006390618B1

(12) United States Patent
Wotton et al.

(10) Patent No.: US 6,390,618 B1
(45) Date of Patent: May 21, 2002

(54) METHOD AND APPARATUS FOR INK-JET PRINT ZONE DRYING

(75) Inventors: Geoff Wotton, Battle Ground; Todd R. Medin, Vancouver, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/479,039

(22) Filed: Jan. 7, 2000

(51) Int. Cl.[7] ..... B41J 2/01
(52) U.S. Cl. ..... 347/102; 347/25
(58) Field of Search ..... 347/25, 102, 104

(56) References Cited

U.S. PATENT DOCUMENTS

| | | | | |
|---|---|---|---|---|
| 4,411,706 A | * | 10/1983 | Wallace et al. | 134/37 |
| 5,287,123 A | | 2/1994 | Medin et al. | 346/140 |
| 5,406,316 A | | 4/1995 | Schwiebert et al. | 347/18 |
| 5,406,321 A | | 4/1995 | Schwiebert et al. | 347/102 |
| 5,461,408 A | | 10/1995 | Giles et al. | 347/102 |
| 5,500,667 A | | 3/1996 | Schwiebert et al. | 347/102 |
| 5,519,420 A | * | 5/1996 | Zorn et al. | 347/25 |
| 5,528,271 A | | 6/1996 | Ebisawa | |
| 5,589,866 A | | 12/1996 | Russell et al. | 347/102 |
| 5,625,398 A | * | 4/1997 | Milkovits et al. | 347/104 |
| 5,633,668 A | | 5/1997 | Schwiebert et al. | 347/102 |
| 5,774,141 A | | 6/1998 | Cooper et al. | 347/34 |

FOREIGN PATENT DOCUMENTS

| | | |
|---|---|---|
| DE | 4021227 | 7/1990 |
| JP | 54156536 | 12/1979 |

OTHER PUBLICATIONS

European Search Report, Mar. 30, 2001.

* cited by examiner

*Primary Examiner*—Craig A. Hallacher

(57) ABSTRACT

An ink-jet hard copy apparatus provides a flow of air across the printing surface of a sheet of print media during printing operations. The airflow scrubs the boundary layer of the printing surface such that paper cockle is reduced by resultant improvement in drying time. A writing instrument deflector is used to prevent substantial interference with ink droplet flight trajectories due to positive airflow through the print zone.

16 Claims, 5 Drawing Sheets

METHOD AND APPARATUS FOR INK-JET PRINT ZONE DRYING

BACKGROUND OF THE INVENTION

1. Field of the Invention

The present invention relates generally to ink-jet hard copy apparatus and, more specifically, to methods and apparatus for drying ink deposited on print media during real-time printing operations.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal*, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy Devices*, chapter 13 (Ed. R. C. Durbeck and S. Sherr, Academic Press, San Diego, 1988).

FIG. 1 (PRIOR ART) depicts an ink-jet hard copy apparatus, in this exemplary embodiment a computer peripheral printer, 101. A housing 103 encloses the electrical and mechanical operating mechanisms of the printer 101. Operation is administrated by an electronic controller 102 (usually a microprocessor or application specific integrated circuit ("ASIC") controlled printed circuit board) connected by appropriate cabling to a computer (not shown). It is well known to program and execute imaging, printing, print media handling, control functions and logic with firmware or software instructions for conventional or general purpose microprocessors or with ASIC's. Cut-sheet print media 105, loaded by the end-user onto an input tray 107, is fed by a suitable paper-path transport mechanism (not shown, but see FIG. 2) to an internal printing station, or "sprint zone," where graphical images or alphanumeric text is created. A carriage 109, mounted on a slider 111, scans the print medium. An encoder 113 is provided for keeping track of the position of the carriage 109 at any given time. A set 115 of individual ink-jet pens, or print cartridges, 117A–117D are releasable mounted in the carriage 109 for easy access (generally, in a full color system, inks for the subtractive primary colors, cyan, yellow, magenta (CYM) and true black (K) are provided). Once a printed page is completed, the print medium is ejected onto an output tray 119. It is common in the art to refer to the pen scanning direction as the x-axis, the paper feed direction as the y-axis, and the ink drop firing direction as the z-axis.

In essence, the ink-jet printing process involves dot-matrix manipulation of droplets of ink ejected from a pen onto an adjacent print medium (for convenience of explanation, the word "paper" is used hereinafter as generic for all forms of print media regardless of its individual constitution). An ink-jet pen includes a printhead which consists of a number of columns of ink nozzles. A column of nozzles (typically less than one-inch in total height) selectively fires ink droplets to create a predetermined print matrix of dots on the adjacently positioned paper as the pen is scanned across the media. A given nozzle of the printhead is used to address a given vertical print column position, referred to as a picture element, or "pixel," on the paper. Horizontal positions on the paper are addressed by repeatedly firing a given nozzle as the pen is scanned. Thus, a single sweep scan of the pen can print a swath of dots. The paper is stepped to permit a series of contiguous or overlapping swaths. Dot matrix manipulation is used to form alphanumeric characters, graphical images, and even photographic reproductions from the ink drops. In the state of the art, the fired droplets of ink are measured in picoliters in volume, producing a printed dot of only about 1/600th inch in diameter; high-end commercial printers are know to produce a 1200 DPI (dots per inch) image.

An important factor in printing with wet ink drops is drying time. The printing of high density plots on plain paper suffers two major drawbacks. First, the saturated media is transformed into an unacceptably wavy sheet. "Ink" generally can be dye-based or pigment-based and uses water or another evaporative solvent as a carrier. When an image to be recorded has high density, a large amount of water is applied to and driven into the medium which in turn swells erratically, causing the printed regions to become wavy or wrinkled, a phenomenon generally known as "cockling." Secondly, adjacent colors tend to run, or "bleed," into one another. Both phenomena degrade print quality.

Preheating the media and post print zone heating of the media are both known in the prior art. In order to speed ink dot drying time on the paper surface and reduce or eliminate cockle and bleed, the print zone is sometimes heated concurrently with the printing operation. In U.S. Pat. No. 5,287,123 for a PREHEAT ROLLER FOR THERMAL INK-JET PRINTER, MEDIN (common inventor herein) et al. (hereinafter referred to as Medin '123) disclose a heating blower system for evaporating ink carriers from the print medium during real-time ink-jet printing. As illustrated summarily in FIG. 2 (PRIOR ART), and referring simultaneously to FIG. 1, Medin '123 provided a cross-flow fan 201 at the exit side of a print zone subjacent a pen 117. The cross-flow fan directs an air flow, arrows 203, at a sheet 205 of print media 105 through the print zone (see "MEDIA DIRECTION" labeled arrows 211) in order to cause turbulence at the medium surface being printed to thereby accelerate evaporation. An exhaust fan 207 having a duct system 209 exhausts air and ink carrier vapor away from the print zone and out of the printer. While in the Hewlett-Packard™ PaintJet™ printer model XL300 contemporary of the patented Medin device, ink drops ranged from forty to one-hundred twenty picoliters in volume, in the current state of the art drop volume has been reduced to ten picoliters. Thus, the ink droplets are much more susceptible to being affected by a cross-flow fan.

There is a need for improved methods and apparatus for scrubbing print media surface boundary layers and for preventing airstreams in the print zone from affecting ink drop flight between pen and paper, while still decreasing cockle and bleed problems inherent in ink-jet printing by improving ink dot drying time.

SUMMARY OF THE INVENTION

In its basic aspects, the present invention provides an ink-jet hard copy apparatus for printing onto a print media, including: ink-jet mechanisms for selectively printing dots of ink on an adjacently positioned print medium at a print zone of the apparatus; transport mechanisms for advancing the print medium via a print medium path through the print zone; and disposed within the apparatus proximate the print zone, airflow mechanisms for producing a substantially laminar flow of air through the print zone during printing operations.

In another basic aspect, the present invention provides a method for drying ink drops deposited on print medium by an ink-jet writing mechanisms for ejecting the ink drops from a predetermined distance between the writing mechanisms and a printing surface of the print medium at a print zone of a hard copy apparatus. The process includes the steps of: heating sequentially received sheets of the print medium such that the printing surface is higher than ambient atmospheric temperature; and providing a laminar flow of air substantially continuously across the printing surface of the sheet through the print zone.

In another basic aspect, the present invention provides an ink-jet hard copy apparatus, having a sheet media input supply and including: a paper transport for sequentially selecting a sheet of print medium from the input supply and transporting the sheet through a print zone region of the apparatus where drops of ink are deposited on a printing surface of the sheet; at least one ink-jet writing instrument for scanning the print zone substantially perpendicularly to direction of transporting the sheet and selectively ejecting drops of ink onto the printing surface, the drops having a predetermined flight time from the instrument to the printing surface; at least one heater mounted with respect to the print zone region for imparting thermal energy to the printing surface such that drying time of drops once deposited on the printing surface is reduced; and at least one airflow device for generating a laminar flow of air through the print zone region and across the printing surface such that drying time of drops once deposited on the printing surface is reduced further from a drying time produced by the heater alone.

In another basic aspect, the present invention provides a scanning ink-jet pen for a hard copy apparatus having a mechanism for producing an air flow through a print zone. The pen includes: printhead mechanisms for firing ink drops from the pen to a surface of adjacently positioned print media, the ink drops having a predetermined flight time between the printhead mechanisms and the surface; and an air flow deflector mounted such that the air flow is interrupted and substantially as prevented from crossing the print zone during the predetermined flight time.

Some advantages of the present invention are:

- it produces more favorable air flow patterns across an ink-jet printer print zone;
- less active heating is required;
- in vacuum platen type apparatus, less vacuum is required;
- any ink drop flight errors caused by air flow through the ink zone are more uniformly distributed and easier to compensate;
- air flow patterns produced more closely to the print zone;
- a more compact commercial product design is enabled;
- ink drop flight is protected from interfering air flow patterns;
- paper cockle is reduced by improved drying time;
- it provides additional cooling for ink-jet printhead mechanisms; and
- it provides a system which drives residual vapor away from the print zone and to a location where it can be captured and filtered.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01 (d) merely to apprize the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable.

Figure 1:
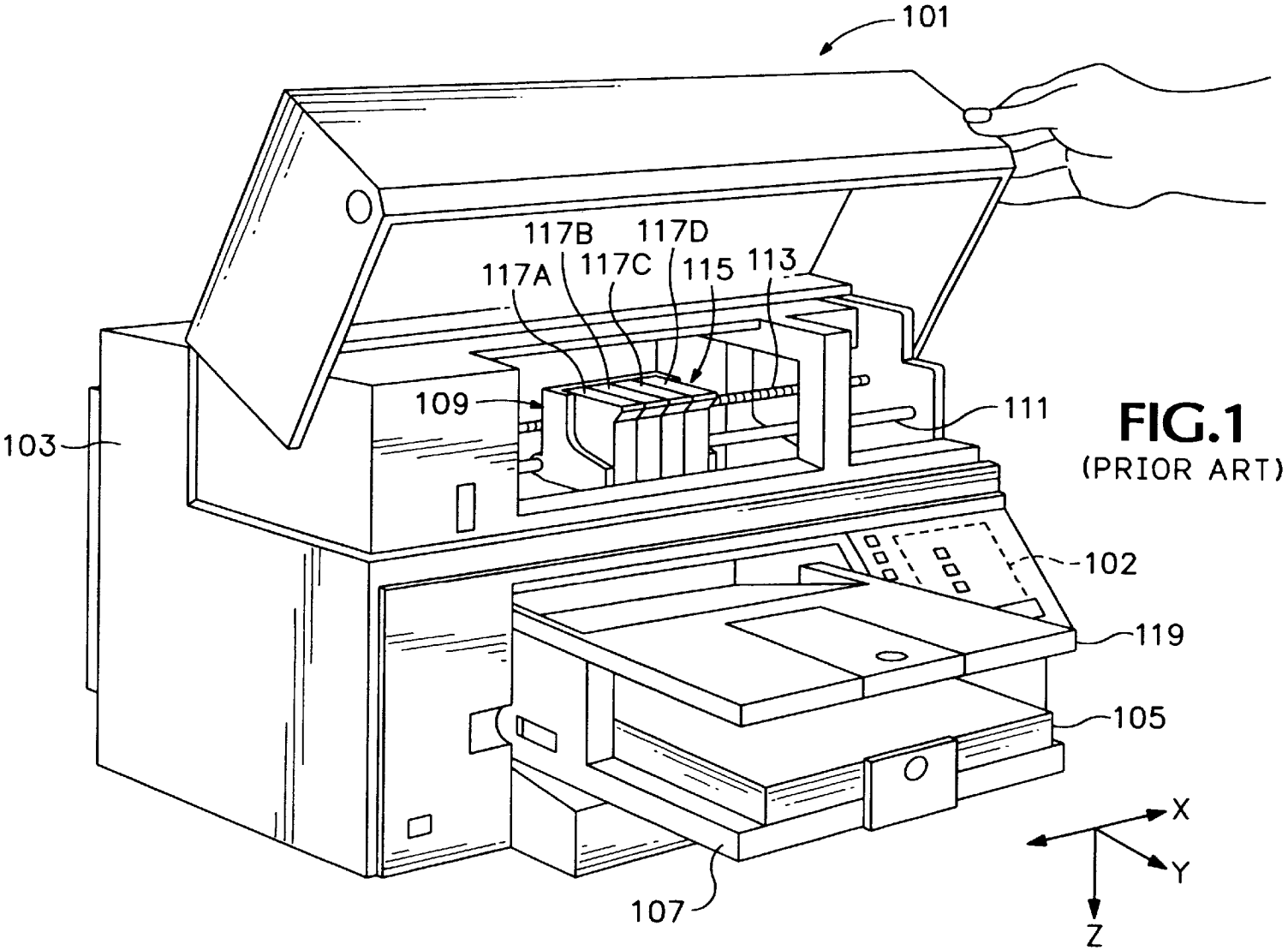
FIG.1 (PRIOR ART)
FIG. 1 (PRIOR ART) is an illustration of an exemplary ink-jet printer.
Figure 3:
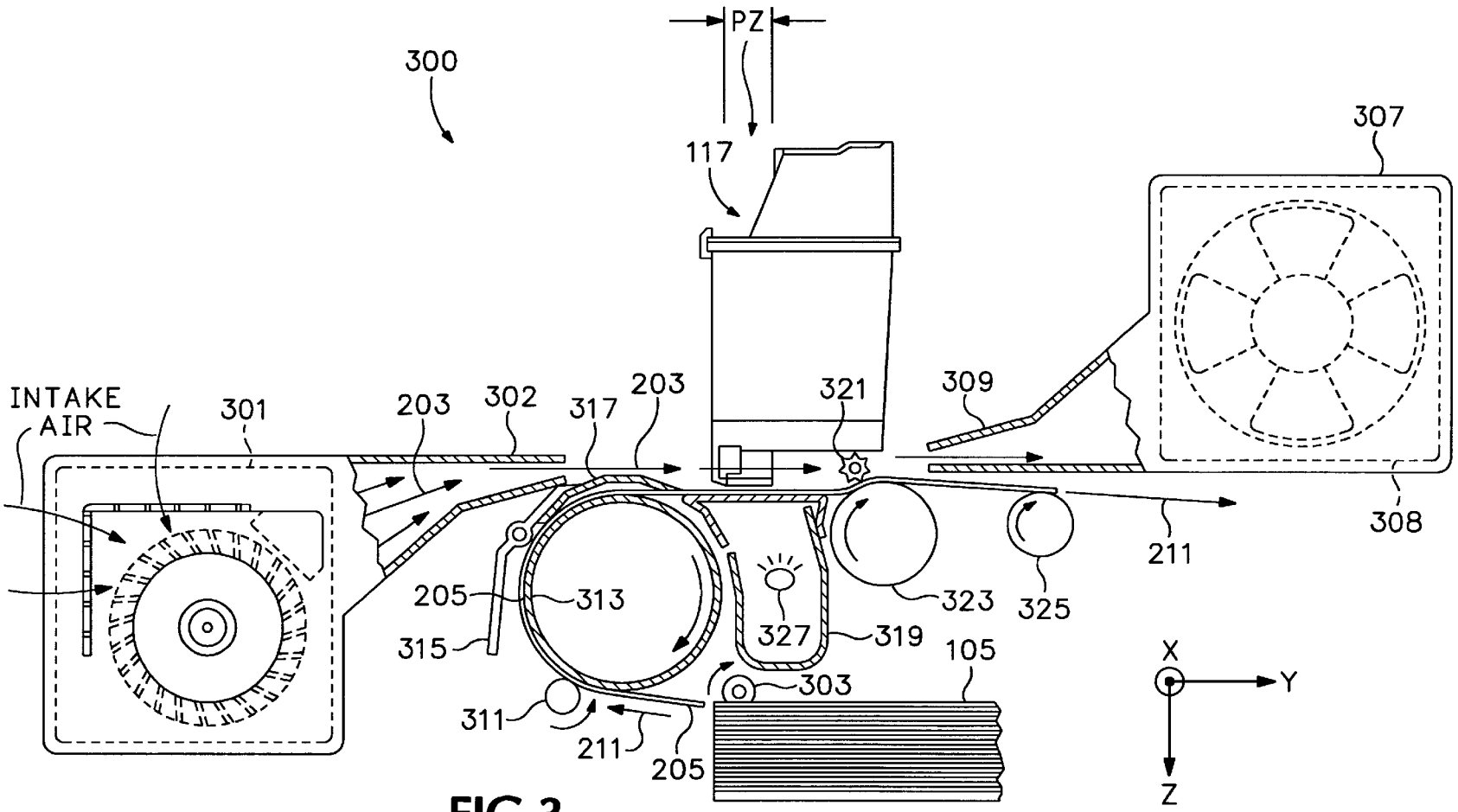
FIG. 3 is a schematic drawing, elevation view, in partial cross-sections of an ink-jet printing system in accordance with the present invention.

An ink jet hard copy apparatus 300 in accordance with the present invention is shown in FIG. 3. A pick roller 303 selects a cut-sheet 205 of the print media 105 (FIG. 1) from the input tray 107 for transport along the paper path, illustrated by arrows 211. Details of paper advance are set out in U.S. Pat. No. 4,990,001 by Underwood et al., including common inventor Medin herein (assigned to the common assignee of the present invention and incorporated herein by reference). In general, orientationally upstream of the print zone, "PZ," a leading edge of the sheet 205 is captured between an idler roller 311 and a drive roller 313; a combination of the idler and rollers 311, 313 and a camming mechanism 315 and drive plate 317 operate to properly position the sheet 205 in the print zone on a platen 319. Similarly, a combination star-wheel 321, exit roller 323, and output stacking roller 325 operate downstream of the print zone to transport the sheet 205 along the paper path 211 and eject the sheet into the output tray 119 (FIG. 1).

One or more ink-jet writing pen 117 traverse the print zone in the x-axis to create swaths of print while the sheet 215 is substantially flat against the platen 319 (note drum platens are also known in the art and can be employed in connection with the present invention). As taught in Medin '123, a heater 327 (halogen quartz bulb 72 therein) provides infrared convective energy to the ink drops deposited onto the print medium in order to evaporate the carrier in the ink; focusing the heat in the print zone and maximizing the available thermal energy.

In order to produce an improved air flow pattern (again illustrated by arrows 203) through the print zone, a cross-flow fan 301 is positioned adjacently to the paper path upstream of the print zone, pulling air in (arrows labeled "intake air"), compressing it, and sending it through a duct system 302 provided to produce a substantially laminar flow 203 of air through the print zone. In this embodiment, the duct system 302 provides the laminar flow 203 across the entire width of the sheet 205 of paper in the pen 117 scanning axis, x-axis. See e.g., Medin '123, FIGS. 15 and 16. Downstream of the print zone, an exhaust fan 307, having a filter 308 and ducting 309, is positioned to pull the air flow 203 through and from the print zone and to filter the carrier vapor and then exhaust away from the print zone and out of the printer. Filters compatible with ink-jet printing are commercially available from 3M Corporation of St. Paul, Minn.

It is preferred that the air flow be established to be as parallel to the paper as possible. With the lowering of drop volume to the current state of the art levels, an angle of incidence greater than twenty degrees will likely disturb flight trajectories. A preferred air flow through the print zone is created in the range of three hundred to seven hundred feet per minute.

For mere convenience of description, the air flow 203 from the paper path 211 upstream side of the print zone is referred to as "positive" flow; that is, the air flow is in the same direction as the media transport direction. An air flow 203 from the downstream side of the print zone, namely in the opposite direction as the media transport direction, is sometimes referred to as "negative" flow.

Figure 2:
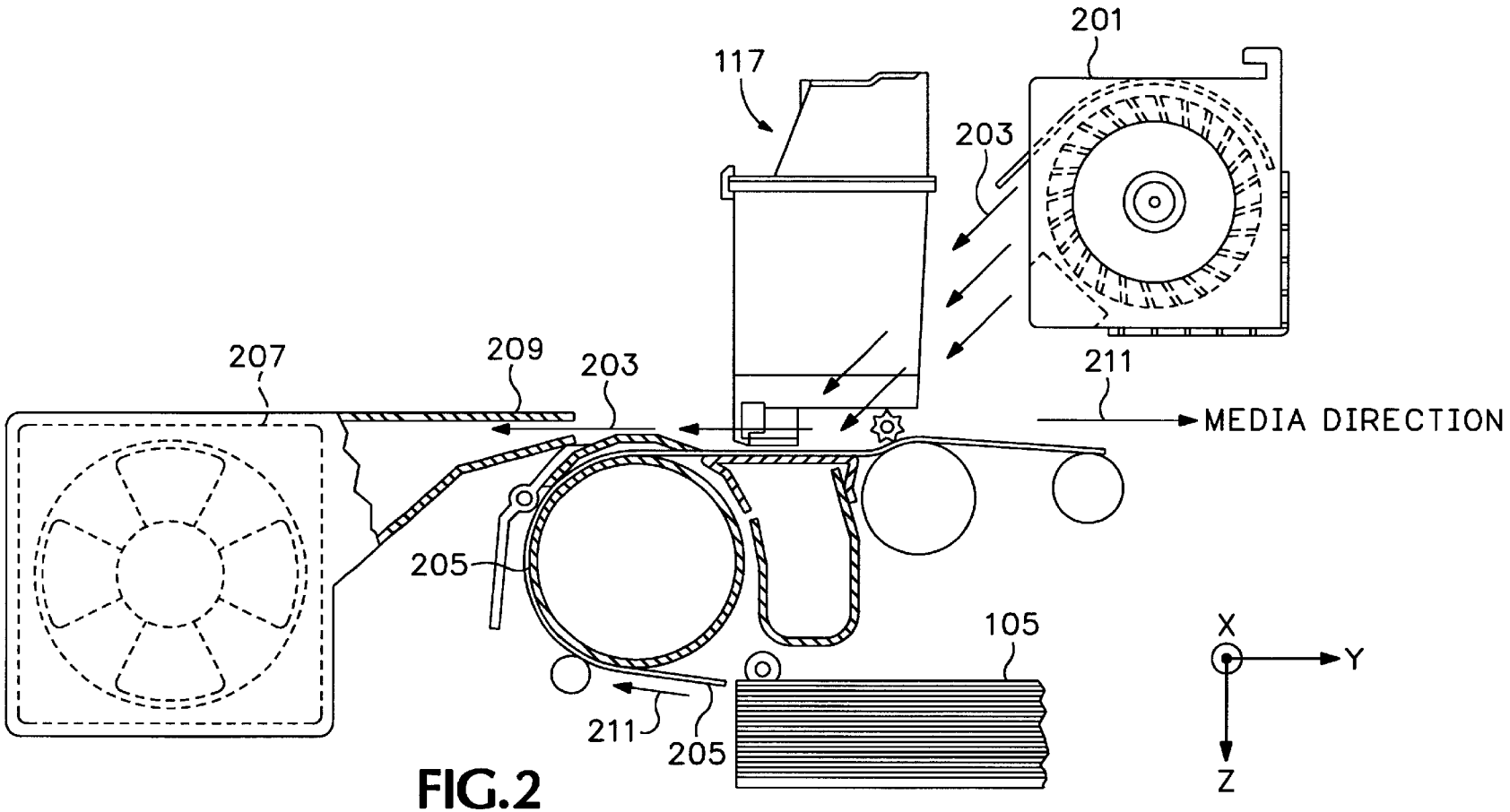
FIG.2 (PRIOR ART)
FIG. 2 (PRIOR ART) is a schematic drawing, elevation view, in partial cross-sections of an ink-jet printing system in accordance with common inventor Medin's disclosure in U.S. Pat. No. 5,287,123.

Compared to the prior art's acute angle of incidence of the air flow into the print zone as shown in FIG. 2, it has been found that pushing air straight over the paper from upstream of the pen 117 produces more favorable air flow patterns, scrubbing the boundary layer along the printed surface of the printed sheet 205 in the print zone. Note that heat radiating toward the upstream side of the print zone along the paper path 211 is returned to the print zone. Any dot errors introduced by the air flow are more uniformly distributed and, with knowledge of a predetermined laminar flow rate and predetermined ink drop flight time, easier to correct as opposed to the random errors which could be instigated in accordance with the acute angled air flow of the prior art.

Figure 4:
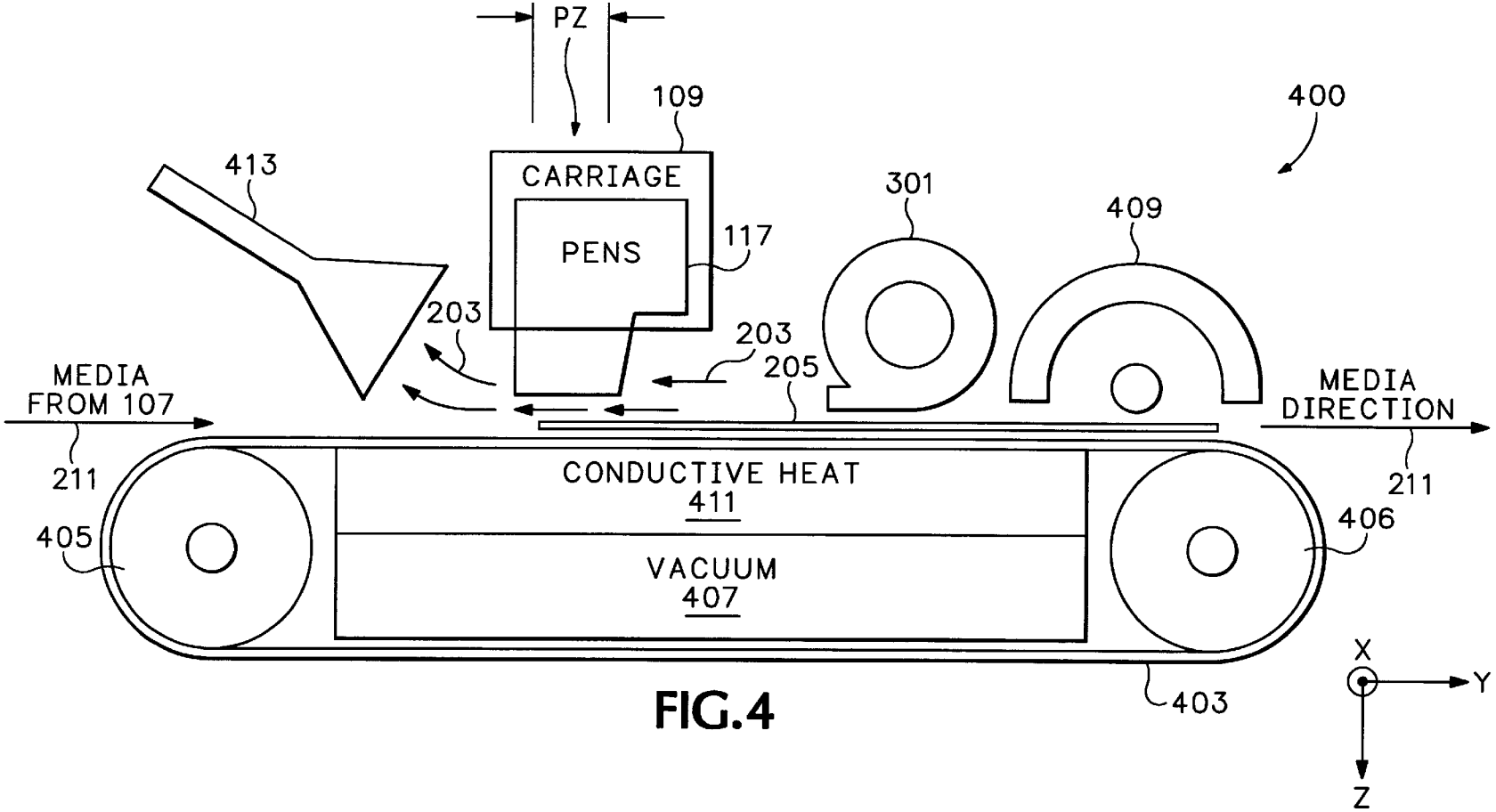
FIG. 4 is a modified system block diagram in accordance with the present invention as shown in FIG. 3.

An alternative embodiment of a hard copy apparatus 401 is shown in FIG. 4. It is known in the art to use vacuum belt systems as a paper transport mechanism. Receiving a picked sheet 205 from the input tray 107 (FIG. 1), an air permeable or apertured belt 403, in the exemplary embodiment shown having a vacuum plenum 407, moving around a pair of drive rollers 405, 406 forms an endless conveyor, transporting sheet media 205 sequentially through the print zone, "PZ," subjacent the ink-jet pens 117. In this embodiment, both a subjacent conductive heat mechanism 411 for transmitting thermal energy to both the belt 403 and the media 201 superjacent the belt as the media is passed from upstream of the print zone, through the print zone and out of the print zone and a post-printing, media heater 409, employing radiant heat, are used. A mass transfer fan 301, positioned downstream of the pens 117 as they traverse the print zone in the x-axis, again provides a substantially laminar air flow pattern 203 through the print zone; note that in this embodiment (and that of FIG. 5 described hereinafter) the air flow 203 is opposite the media transport direction 211. A vapor management exhaust system 413 is positioned downstream of the print zone.

Figure 5:
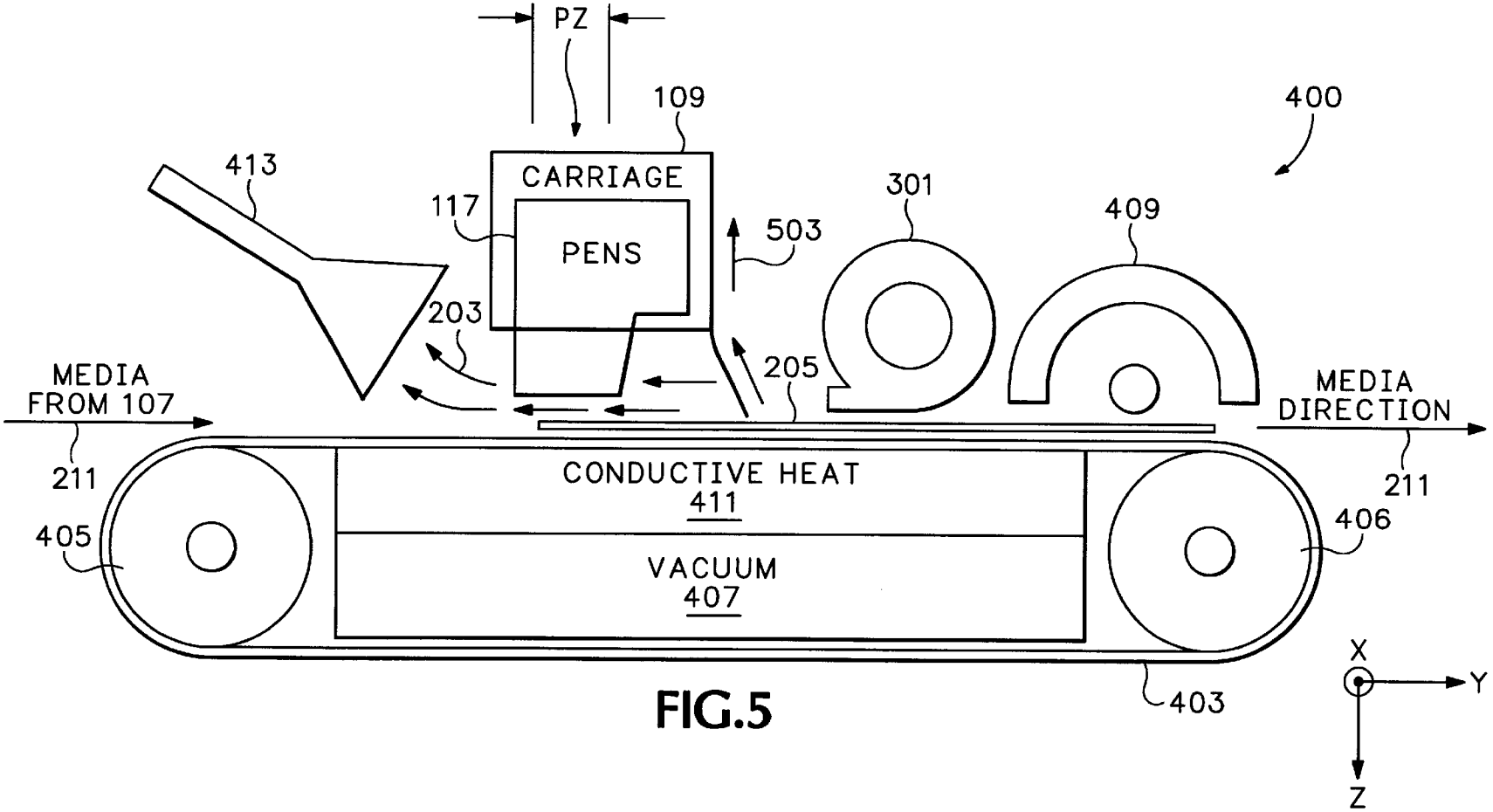
FIG. 5 is an alternative embodiment ink-jet writing instrument implementation in accordance with the present invention as shown in FIGS. 3 and 4.

As mentioned, an induced air flow 203 through the print zone will naturally affect ink drop trajectories between the pen 117 and the printing surface of the paper 205. In furtherance of the present invention as illustrated in FIG. 5, it has been found that providing an optional deflector 501 on the pen carriage 109 or pen 117 redirects the air flow 203 away from the print zone, as illustrated by arrows 503 during the ink drop transit time between the pen and the paper 205 surface as the carriage scans the pen 117 across the paper 205. [Ink drop trajectory problems are well known to persons skilled in the art; further discussion here is not necessary to an understanding of the present invention; see e.g., *Hewlett-Packard Journals*, supra. ] The deflector 501 shields the print zone during deposition of ink drops from the positive air flow. The air flow 203 immediately returns across the surface after the drops have already been deposited.

The foregoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more." Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for. . . . "

What is claimed is:

1. An ink-jet hard copy apparatus for printing onto a print media, comprising:

ink-jet means for selectively printing dots of ink on an adjacently positioned print medium at a print zone of the apparatus;

transport means for advancing the print medium via a print medium path through the print zone; and disposed within the apparatus proximate the print zone, airflow means for producing a substantially laminar flow of air through the print zone during printing operations.

2. The apparatus as set forth in claim 1, comprising:

the airflow means includes a mass transfer means for producing a positive laminar flow through the print zone from the upstream direction of the print medium path.

3. The apparatus as set forth in claim 1, comprising:

the airflow means includes a mass transfer means for producing a negative laminar flow through the print zone from the downstream direction of the print medium path.

4. The apparatus as set forth in claim 1, comprising:

the airflow means includes a vapor management means for exhausting residual printing operation vapor from the print zone.

5. The apparatus as set forth in claim 1, comprising:

the ink-jet means has at least one scanning ink-jet printhead and deflector means for substantially eliminating interference with ink drop trajectory by the laminar flow of air through the print zone in the immediate print zone region of the printhead during printing.

6. A method for drying ink drops deposited on print medium by an ink-jet writing means for ejecting the ink drops from a predetermined distance between the writing means and a printing surface of the print medium at a print zone of a hard copy apparatus, comprising the steps of:

heating sequentially received sheets of the print medium such that the printing surface is higher than ambient atmospheric temperature; and providing a laminar flow of air substantially continuously across the printing surface of the sheet through the print zone.

7. The method as set forth in claim 6, comprising the step of:

selectively interrupting the laminar flow from the upstream side of the print zone during ink drop flight time between the writing means and the printing surface such that the laminar flow does not substantially affect flight trajectories of ink drops.

8. An ink-jet hard copy apparatus, having a sheet media input supply, comprising:

a paper transport for sequentially selecting a sheet of print medium from the input supply and transporting the sheet through a print zone region of the apparatus where drops of ink are deposited on a printing surface of the sheet;

at least one ink-jet writing instrument for scanning the print zone substantially perpendicularly to direction of transporting the sheet and selectively ejecting drops of ink onto the printing surface, the drops having a predetermined flight time from the instrument to the printing surface;

at least one heater mounted with respect to the print zone region for imparting thermal energy to the printing surface such that drying time of drops once deposited on the printing surface is reduced; and at least one airflow device for generating a laminar flow of air through the print zone region and across the printing surface such that drying time of drops once deposited on the printing surface is reduced further from a drying time produced by the heater alone.

9. The apparatus as set forth in claim 8, the airflow device further comprising:

a mass transfer fan device mounted in the apparatus proximate the print zone region upstream thereof with respect to the sheet transport path through the print zone region such that a positive, boundary layer, airflow is established along the print surface at least across the entire print zone in a scanning axis of the writing instrument.

10. The apparatus as set forth in claim 8, the airflow device further comprising:

a mass transfer fan device mounted in the apparatus proximate the print zone region downstream thereof with respect to the sheet transport path through the print zone region such that a negative, boundary layer, airflow is established along the print surface at least across the entire print zone in a scanning axis of the writing instrument.

11. The apparatus as set forth in claim 8, the airflow device further comprising:

a vapor management exhaust device mounted in the apparatus proximate the print zone region thereof with respect to the sheet transport path through the print zone region airflow is drawn along the print surface at least across the entire print zone in a scanning axis of the writing instrument.

12. The apparatus as set forth in claim 8, the airflow device further comprising:

the writing instrument having shield for substantially eliminating interference with ink drop trajectory during the predetermined flight time by the laminar flow of air.

13. The apparatus as set forth in claim 8, comprising:

the laminar flow of air is substantially parallel to the printing surface.

14. The apparatus as set forth in claim 8, comprising:

the laminar flow of air into the print zone impinges on the printing surface with an angle of incidence of less than approximately twenty degrees.

15. The apparatus as set forth in claim 8 comprising:

the laminar flow of air through the print zone is in an approximate range three hundred feet per minute to seven hundred feet per minute.

16. A scanning ink-jet pen for a hard copy apparatus having a means for producing an air flow through a print zone, comprising:

printhead means for firing ink drops from the pen to a surface of adjacently positioned print media, the ink drops having a predetermined flight time between the printhead means and the surface; and an air flow deflector mounted such that the air flow is interrupted and substantially prevented from crossing the print zone during the predetermined flight time.

* * * * *